US011846099B2

(12) United States Patent
Phillips

(10) Patent No.: US 11,846,099 B2
(45) Date of Patent: Dec. 19, 2023

(54) ACOUSTIC SEAL AND A SOUND PROOF BOOTH COMPRISING THE SAME

(71) Applicant: TRIESTE GROUP ONE LTD, Hertfordshire (GB)

(72) Inventor: Roger Phillips, Hertfordshire (GB)

(73) Assignee: TRIESTE GROUP ONE LTD, Hertfordshire (GB)

( * ) Notice: Subject to any disclaimer, the term of this patent is extended or adjusted under 35 U.S.C. 154(b) by 0 days.

(21) Appl. No.: 17/072,272

(22) Filed: Oct. 16, 2020

(65) Prior Publication Data

US 2021/0115663 A1 Apr. 22, 2021

(30) Foreign Application Priority Data

Oct. 18, 2019 (GB) ..... 1915148

(51) Int. Cl.
*E04B 1/82* (2006.01)
*E04H 1/12* (2006.01)
*E04B 1/84* (2006.01)

(52) U.S. Cl.
CPC ..... *E04B 1/8218* (2013.01); *E04B 1/84* (2013.01); *E04H 1/125* (2013.01); *E04B 2001/8414* (2013.01); *E04B 2001/8428* (2013.01)

(58) Field of Classification Search
CPC . F16B 5/121; F16B 2/22; F16L 55/033; F16L 55/0331; F16L 55/0332; F16L 55/0333; F16L 55/0335; F16L 55/0336; F16L 55/0337; F16L 55/0338; G10K 11/16; E04B 2/7403; E04B 2/7409; E04B 2001/8414; E04B 2001/8461; E04B 2001/8471; E04B 2001/4428
See application file for complete search history.

(56) References Cited

U.S. PATENT DOCUMENTS 2,229,775 A * 1/1941 Sherron ..... E04H 1/14 52/262
2,349,144 A 5/1944 Corso
2,912,073 A 11/1959 Sherron
3,514,916 A * 6/1970 Hoverman, Jr. ..... B60J 10/70 428/125
3,571,994 A * 3/1971 Brown ..... E06B 3/6205 52/204.597

(Continued)

FOREIGN PATENT DOCUMENTS

CA 1004151 A1 1/1977
CH 590532 A5 8/1977

(Continued)

OTHER PUBLICATIONS

Combined Search and Examination Report dated May 4, 2020, issued in GB Patent Application No. 1915148.9, 4 pages.

(Continued)

*Primary Examiner* — Jessica L Laux
(74) *Attorney, Agent, or Firm* — Lewis Roca Rothgerber Christie LLP

(57) ABSTRACT

An acoustic seal comprising an extrusion, which comprises a body portion and a plurality of deformable protrusions that project from the body portion, the protrusions comprising a first protrusion and a second protrusion that are spaced from one another. A sound proof booth comprising the seal.

13 Claims, 5 Drawing Sheets

(56) References Cited

U.S. PATENT DOCUMENTS

| | | | | | |
|---|---|---|---|---|---|
| 3,675,379 | A * | 7/1972 | Lambert | E04B 1/08 52/264 |
| 3,866,374 | A * | 2/1975 | Dallen | E04B 2/967 52/204.597 |
| 4,006,569 | A * | 2/1977 | Kain | E06B 3/5454 52/204.591 |
| 5,060,752 | A * | 10/1991 | Heiberger | E04B 1/8218 181/291 |
| 5,210,984 | A * | 5/1993 | Eckel | E04B 1/8218 52/265 |
| 5,682,622 | A | 11/1997 | Tagg | |
| 2018/0010350 | A1 | 1/2018 | Sansom, III et al. | |
| 2019/0323522 | A1 * | 10/2019 | McNair | F02C 7/045 |

FOREIGN PATENT DOCUMENTS

| | | | |
|---|---|---|---|
| CN | 203961349 | U | 11/2014 |
| DE | 3503314 | A1 | 8/1986 |
| DE | 10 2009 061 037 | A1 | 2/2011 |
| GB | 228 728 | A | 4/1971 |
| GB | 2230029 | A | 10/1990 |
| GB | 2535631 | A | 8/2016 |
| JP | 9-302962 | A | 11/1997 |
| JP | 3192588 | B2 | 5/2011 |
| JP | 5207181 | B2 | 6/2013 |
| NL | 8900664 | A | 10/1990 |
| WO | 82/02915 | A1 | 9/1982 |
| WO | 2020/178587 | A1 | 9/2020 |
| WO | WO20200178583 | A1 | 9/2020 |

OTHER PUBLICATIONS

International Search Report of corresponding PCT/GB2020/050516, dated May 25, 2020, 4 pages.

Written Opinion of the International Searching Authority of corresponding PCT/GB2020/050516, dated May 25, 2020, 6 pages.

Search Report of corresponding GB 1903024.6, dated Dec. 16, 2019, 1 page.

International Search Report of corresponding PCT/GB2020/050520, dated May 26, 2020, 5 pages.

Written Opinion of the International Searching Authority of corresponding PCT/GB2020/050520, dated May 25, 2020, 6 pages.

Search Report of corresponding GB 1903025.3, dated Dec. 16, 2019, 1 page.

Extended European Search Report dated Nov. 2, 2020, issued in EP Application No. 20202405.5.

Combined Search and Examination Report dated Apr. 7, 2021, issued in GB Application No. GB2016448.9.

* cited by examiner

ACOUSTIC SEAL AND A SOUND PROOF BOOTH COMPRISING THE SAME

CROSS-REFERENCE TO RELATED APPLICATION(S)

This application claims priority to and the benefit of British Patent Application No. 1915148.9, filed Oct. 18, 2019, the entire content of which is incorporated herein by reference.

SUMMARY

The present invention relates to an acoustic seal, and to a booth comprising the seal.

Open plan working environments, such as office spaces, provide many advantages including the efficient use of available space and the promotion of interaction between workers using the space. However, such open plan environments suffer drawbacks where, for example, workers require a quiet space in which to concentrate on work, conduct meetings or make telephone calls.

To address this issue, some open plan office spaces are provided with a limited number of isolated offices or meetings rooms, which can be used by workers when a quieter or more private environment is required. Such isolated spaces are typically built into the permanent structure of the office space, and are commonly located at or towards the periphery of the office space for convenience.

A disadvantage of this arrangement is that such isolated spaces are generally inflexible and immobile and thus cannot be easily adapted in response to the changing requirements of the users of the office space. For example, an organisation owning or renting an office space may experience fluctuations in the number of workers using the office space, and thus the number of isolated spaces required may vary over time. Similarly, the occupants of a rented office space may change on a regular or semi-regular basis, with different occupants having different requirements in terms of the number or nature of isolated spaces within the office space.

To address these issues the use of freestanding soundproofed booths which can be readily re-located, and which provide a convenient isolated space for a worker or workers in an open plan office environment, are becoming more popular.

Soundproof booths are sealed structures. A problem can arise when re-locating such booths with uneven floors introducing gaps between panels of a booth and a supporting substructure, or between the booth and the floor, which can diminish soundproofing.

The present invention arose in a bid to provide an improved soundproof booth.

According to the present invention in a first aspect there is provided an acoustic seal comprising an extrusion, which comprises a body portion and a plurality of deformable protrusions that project from the body portion, the protrusions comprising a first protrusion and a second protrusion that are spaced from one another.

Extrusion is a process used to create objects of a fixed cross-sectional profile: by way of example, a material is pushed through a die of the desired cross-section. The resulting product is termed an extrusion.

In a preferred embodiment, the body portion is elongate, extending in a longitudinal direction, and the first and second protrusions project from the body portion in a direction generally transverse to the longitudinal direction of the body portion: the first and second protrusions extend in the longitudinal direction, preferably continuously.

The first and second protrusions preferably project in a first direction from the body portion. Preferably no first or second protrusions project in a second, opposite, direction from the body portion.

The first and second protrusions may extend from the body portion by different distances. Preferably, the second protrusion extends further from the body portion than the first protrusion. The second protrusion preferably projects from a longitudinal edge of the body portion.

The body portion is preferably substantially planar. Each protrusion may be substantially perpendicular to the body portion at its junction with the body portion.

The protrusions may comprise fins. The fins may be curved when in an un-deformed state. The fins may be tapered in a direction extending away from the body portion. The fin defining the first protrusion may comprise an undercut at a base of the fin where the fin is joined to the body portion.

The extrusion preferably comprises an elastomeric material. It may be formed from silicone. The extrusion is preferably sufficiently flexible to bend around corners, edges or bends while having sufficient rigidity to prevent overcompression of the first and second protrusions. The extrusion of the acoustic seal is elongate.

The extrusion of the acoustic seal is preferably formed from a single material, thereby having a substantially uniform flexibility. There may be no regions of the extrusion which are formed of a more rigid or a more flexible material.

A surface of the body portion, which is opposed to a surface of the body portion from which the protrusions project, preferably comprises a self-adhesive coating, an adhesive layer (eg adhesive tape) or interconnecting means (eg lugs).

Interconnecting means may be provided to connect the acoustic seal to an adjacent supporting member. The interconnecting means may be provided on a surface of the body portion opposed to a surface of the body portion from which the protrusions project. The acoustic seal is thereby removably attachable to a supporting member.

The interconnecting means may comprise one or more lugs which project from the surface of the body portion to connect the acoustic seal to an adjacent supporting member provided with a corresponding slot or channel to accommodate the lug(s). The adjacent supporting member may be the base of a booth.

The interconnecting means may be an interconnecting section extending between two body portions. The first and second protrusions of a first body portion may project therefrom in a direction which is opposite to the direction of projection of first and second protrusions from a second body portion. The first and second body portions may be substantially parallel to one another. The interconnecting section may extend between the first body portion and the second body portion to provide an extrusion having a general U-shape, H-shape or inverted U-shape in cross-section. In a preferred embodiment, the interconnecting section is adjacent the second protrusion of each body portion and may extend between longitudinal edges of the body portions. An adjacent supporting member, for example the base of a booth, may be located within the extrusion.

The first protrusion may project from, or project adjacent to, a longitudinal edge of the body portion. The second protrusion may project from, or project adjacent to, an opposing longitudinal edge of the body portion.

The acoustic seal preferably comprises a plurality of the first protrusions: in this respect, the first protrusions of the acoustic seal may be two to ten in number, preferably two to five in number. Preferably the first protrusions have substantially the same dimensions, while being spaced from each other along the surface of the body portion from which they project. This spacing may be substantially uniform.

The second protrusion preferably has an external surface adapted to contact a floor, this external surface facing away from the adjacent first protrusion.

The acoustic seal preferably has a single second protrusion.

In one embodiment, the acoustic seal has a first protrusion projecting from, or projecting adjacent to, a first longitudinal edge of the body portion, a second protrusion projecting from, or projecting adjacent to, a second (opposing) longitudinal edge of the body portion and a plurality of further protrusions (preferably being first protrusions) located between said first protrusion and said second protrusion and projecting from a surface of the body portion in the same direction as said first protrusion and said second protrusion. No protrusions project from the body portion in the opposite direction to the first and second protrusions, other than any interconnecting means provided. Preferably, the acoustic seal consists of a plurality of first protrusions and a single second protrusion.

In use of the acoustic seal, the first protrusion or first protrusions are adapted to be compressed and the second protrusion is adapted to be in contact with a surface, with substantially no compression.

Providing a plurality of first protrusions is advantageous in that it allows for an acoustic seal to be formed in situations where the floor level is uneven, as will be explained in more detail below.

Since the acoustic seal is designed to attenuate sound, it is not provided with openings that would allow air to pass through the seal.

According to the present invention in a further aspect, there is provided a soundproof booth comprising a seal as recited above.

According to the present application in a further aspect, there is provided a soundproof booth comprising upstanding peripheral walls, a roof, a base upon which the booth stands in use, and an acoustic seal, wherein the base extends along a basal edge of at least one of the walls, which comprises an outer panel, and the acoustic seal extends along the basal edge of the wall, sandwiched between the base and the outer panel, for sealing a gap between the outer panel and the base, the acoustic seal comprising an extrusion, which comprises a body portion and a plurality of deformable protrusions that project from the body portion.

One of the protrusions is preferably arranged to be compressed between the outer panel and the base, and one of the protrusions is preferably arranged to contact the floor to seal between the base and the floor.

The protrusions may comprise a first protrusion and a second protrusion that are spaced from one another and extend from the body by different distances, the first protrusion arranged to be compressed between the outer panel and the base and being shorter than the second protrusion, which is arranged to contact the floor to seal between the base and the floor.

The acoustic seal preferably extends along the basal edge of each of a plurality of the walls. The acoustic seal may extend around substantially the entire periphery of the base. It may extend continuously around the periphery of the base. The base may be substantially U-shaped in cross-section. The base may comprise elongate sections, arranged to form the periphery of the base. The elongate sections may be substantially U-shaped in cross-section. The acoustic seal may extend around substantially the entire periphery of the elongate sections forming the base.

In a preferred embodiment, the booth is not provided with a floor section: instead the existing floor is used to mount the booth thereon with the base providing support for the walls of the booth. The base may be fixed to the floor.

The soundproofing booth of the present invention may be sized to stand on or be fixed to a relatively small area of floor, for example 1 $m^2$, but may alternatively be sized to stand on or be fixed to a relatively large area of floor, for example 100 $m^2$. The level of the floor may be uneven. However, the plurality of deformable first and second protrusions of the acoustic seal and their spaced configuration allow the acoustic seal to perform the important function of acoustically-sealing the booth, notwithstanding the different floor levels of the area of floor on which the booth stands or is fixed.

In one embodiment, while the second protrusion is arranged to contact the floor to seal between the base and the floor and the first protrusion is arranged to be compressed between the outer panel and the base, one or more further protrusions (preferably being first protrusions) may be provided that may or may not be compressed between the outer panel and the base, depending on the floor level and the location and spacing of the further protrusion(s) relative to the first and second protrusions. In this respect, a plurality of first protrusions may be provided adjacent the second protrusion and these first protrusions may be compressed, partially compressed or uncompressed in use, depending on the relative levels of the floor (and therefore the base of the booth), the acoustic seal and the wall.

The configuration of the acoustic seal of the present invention therefore enables an acoustic seal to be provided between the base of the booth and an uneven floor.

The acoustic seal may be arranged in accordance with any of the above statements detailing features of the acoustic seal.

BRIEF DESCRIPTION OF THE DRAWINGS

Non-limiting embodiments of the present invention will now be described, by way of example only, with reference to the accompanying drawings, in which.

DETAILED DESCRIPTION

Figure 1:
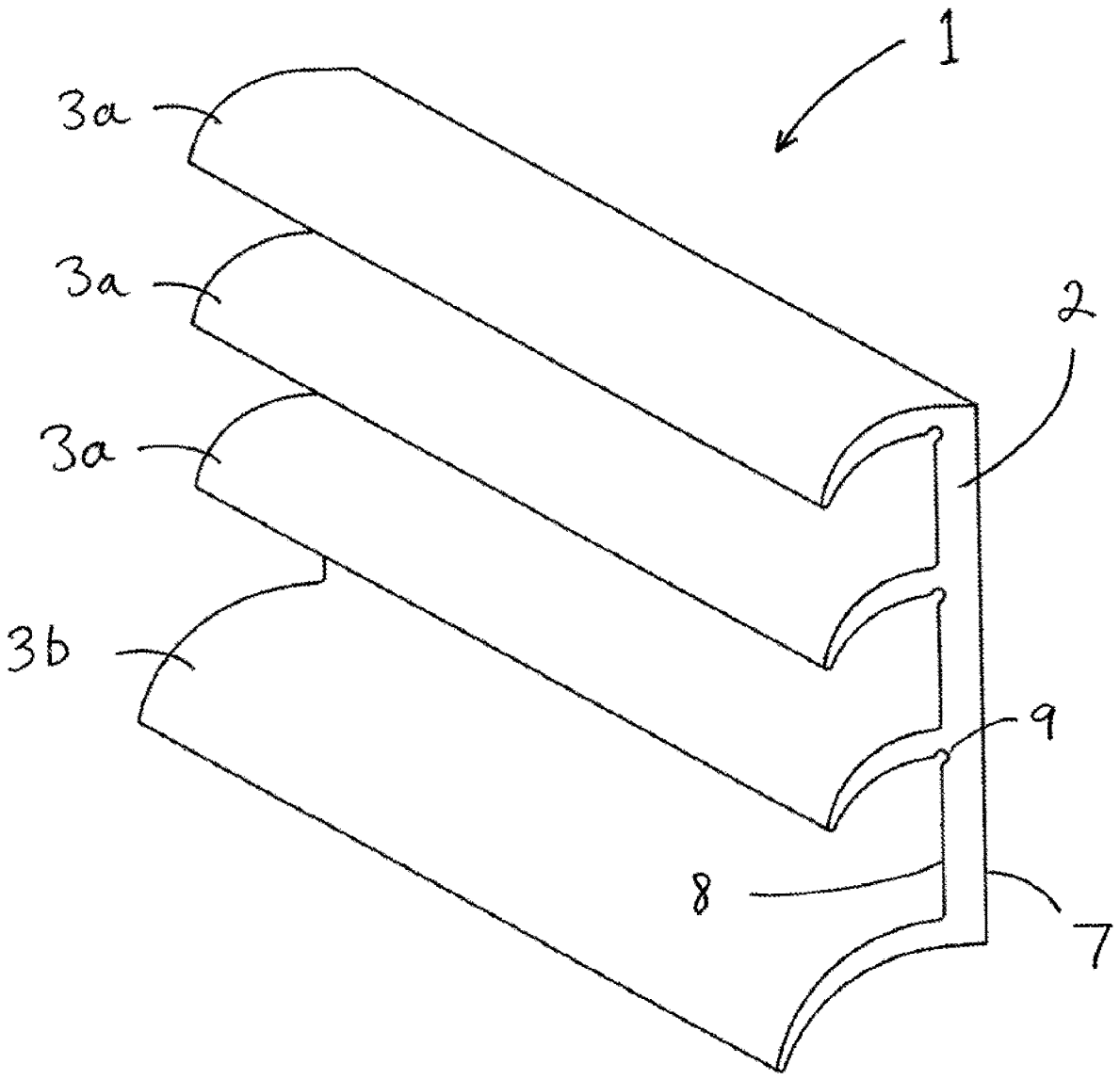
FIG. 1 is a perspective view of a short length of an acoustic seal according to a first embodiment.
Figure 3:
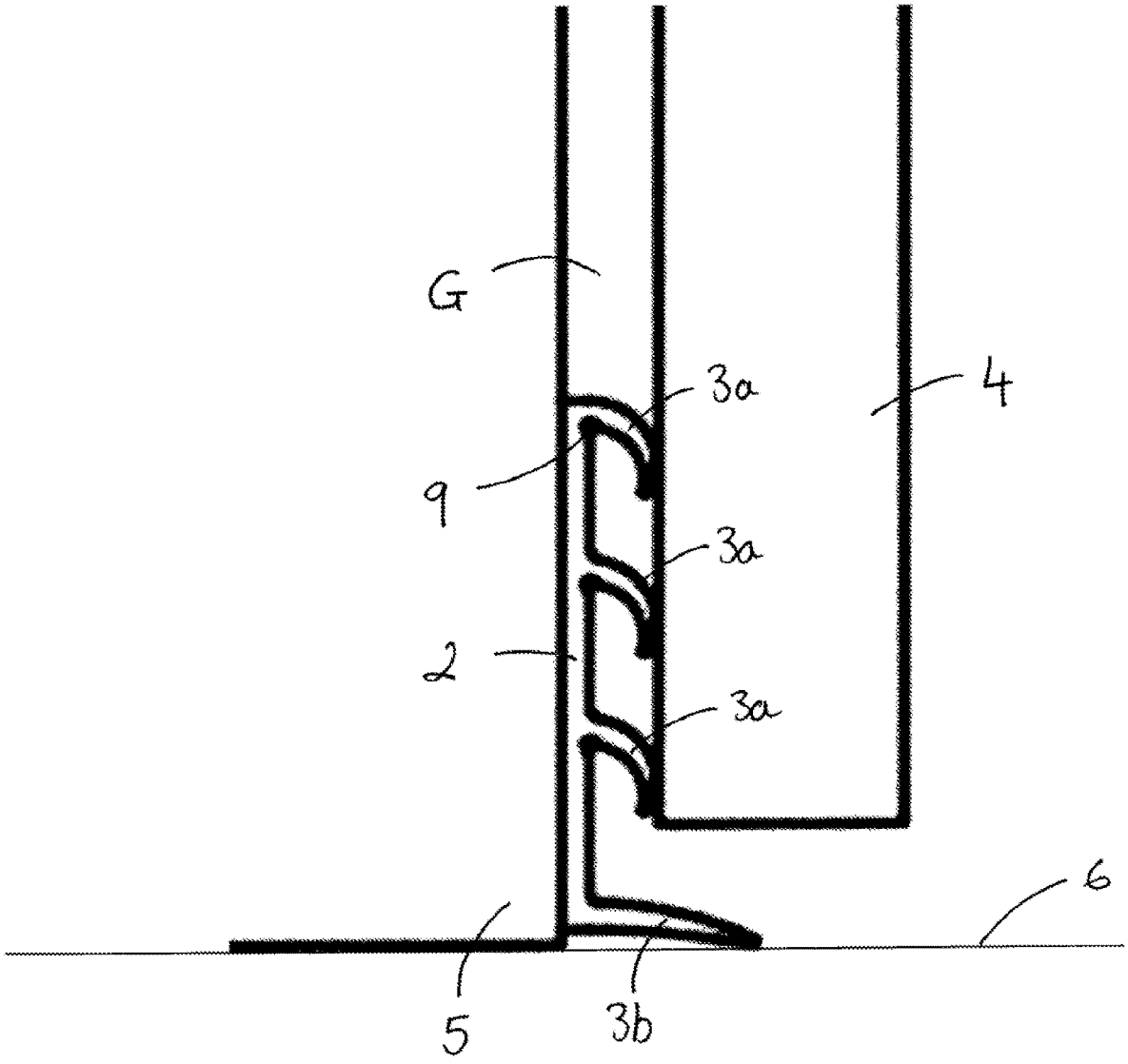
FIG. 3 is a close-up schematic view of the seal of FIG. 1 as part of the booth of FIG. 2, compressed between a base section and a panel.

As shown in FIGS. 1 and 3, there is provided an acoustic seal 1. The acoustic seal 1 comprises an extrusion extending in a longitudinal direction, which comprises an elongate body portion 2 and a plurality of elongate deformable protrusions 3*a*, 3*b* that project from the body portion 2 in a transverse direction. The protrusions 3*a*, 3*b* comprise first protrusions 3*a* and a second protrusion 3*b*. The protrusions 3*a*, 3*b* are spaced from one another along the body portion in a width direction which is generally perpendicular to the longitudinal direction and to the transverse direction, as clearly shown. The second protrusion 3*b* is preferably provided at a basal edge of the acoustic seal in use with the first protrusions 3*a* spaced vertically from the second protrusion 3*a*.

It should be noted that whilst there are a plurality of the first protrusions 3*a* provided and a single second protrusion 3*b*, this need not be the case in alternative arrangements. There could be more or less of the first protrusions 3*a*, including a single first protrusion 3*a* and there could be additional second protrusions 3*b*.

It is preferable that the first and second protrusions 3*a*, 3*b* extend from the body portion 2 in the transverse direction by different distances. In the present arrangement, as is preferred, the second protrusion 3*b* projects from the body portion 2 by a greater distance than the first protrusions 3*a*. As seen in FIG. 3, and discussed further below, the first protrusions 3*a* are arranged to seal a gap between an outer panel 4 and a base 5 of a booth 100 whilst the second protrusion 3*b* is arranged to seal between the base 5 and the floor 6.

The body portion 2 is preferably substantially planar, as shown, but could take alternative forms, particularly due to its flexibility. A surface 7 (being a longitudinal side of the body portion 2) that is opposed to a surface 8 (being another longitudinal side of the body portion 2) from which the protrusions 3*a*, 3*b* project, may comprise a self-adhesive coating for attaching the acoustic seal 1 to appropriate surfaces during use. These surfaces may be provided by the base of the booth.

Alternatively (or in addition), interconnecting means are provided to connect the acoustic seal to one or more adjacent supporting members provided, in this example, by the base of the booth. The interconnecting means is provided on a surface of the body portion opposite to the surface from which the first and second protrusions project. The acoustic seal is thereby removably attachable to a supporting member, eg the base of the booth.

The protrusions 3*a*, 3*b* may comprise fins, as shown, or may take alternative suitable forms. For example, they could be hollow and square, triangular or round in profile.

The fins are preferably curved when in an un-deformed state, as shown in FIG. 1. The fins could alternatively be straight. The fins are preferably angled downward in use, as seen in FIG. 3. The fins may be tapered in a direction extending away from the body portion, as seen in FIGS. 1 and 3, such that they get thinner towards their free ends.

Each of the fins defining one of the first protrusions 3*a* is preferably provided with an undercut 9 at a base of the fin where the fin is joined to the body portion 2. The use of an undercut 9 helps in the provision of a stiffer rib, less prone to collapse and better prone to resiling, whilst allowing for sufficient collapsibility to avoid undesirable spacing between the elements it is sandwiched between. The fin defining the second protrusion 3*b* could also comprise an undercut 9

The extrusion preferably comprises an elastomeric material. The material is not particularly limited so long as it exhibits good resilience. Silicone has been found to be a particularly suitable material.

Figure 2:
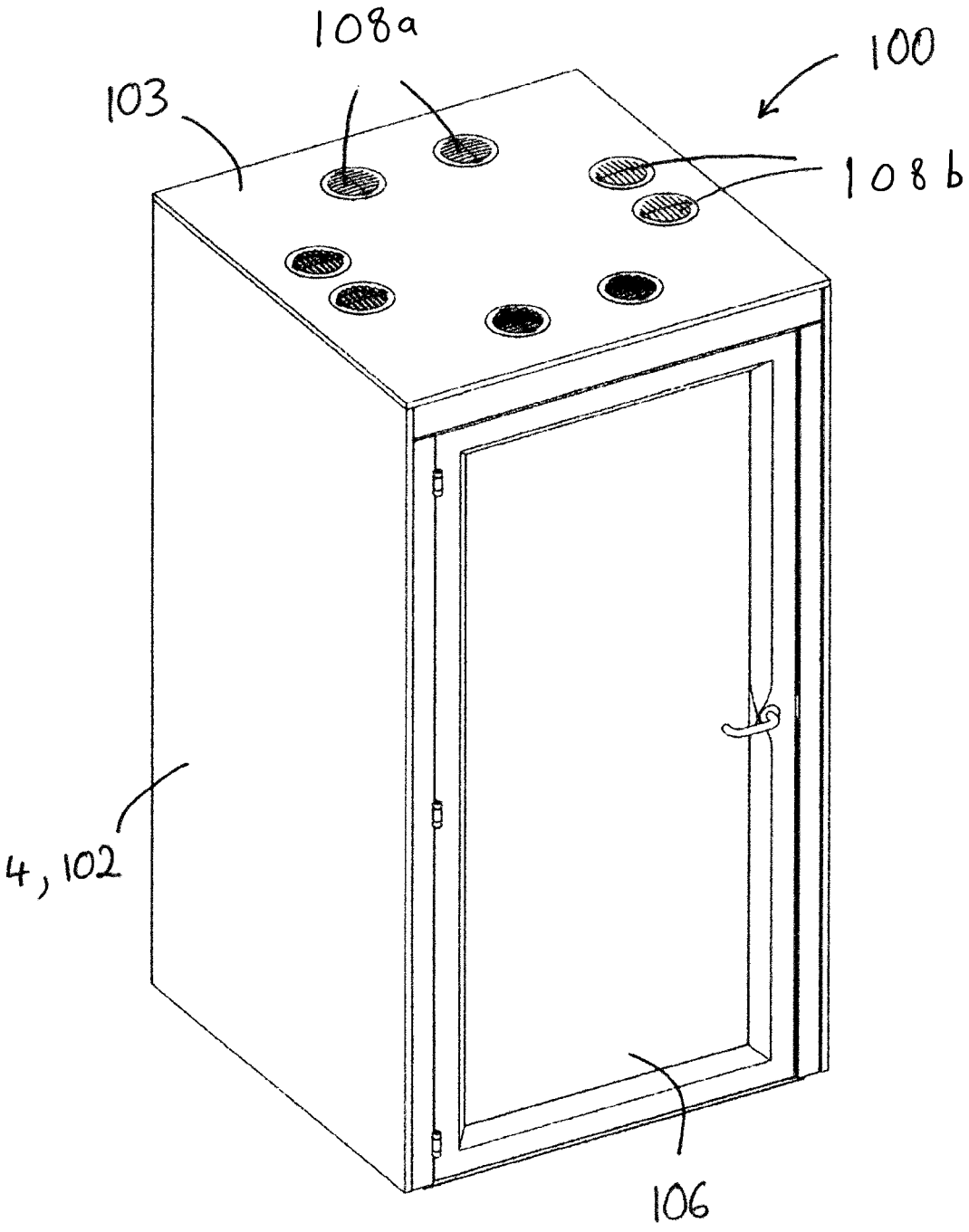
FIG. 2 is a perspective view of a booth comprising the seal of FIG. 1.

With reference to FIG. 2, there is shown a freestanding booth 1 according to an embodiment of the present invention. The booth is provided with the acoustic seal of FIGS. 1 and 3. The base of the booth may be fixed to an existing floor. The booth may not be provided with its own floor section.

The booth comprises upstanding peripheral walls 102, a roof 103 and a base 5 (shown schematically in FIG. 3) upon which the booth stands in use. One of the walls 102 defines an opening that is closed by a door 106 mounted for hinged opening. The base 5 extends along a basal edge of a plurality of the walls 102.

Whilst in the present arrangement the booth has four walls 102 (and thereby four sides) it could have more or less walls/sides in alternative arrangements. The principals of its construction, as discussed in greater detail below will be suitable for constructing booths having numerous forms, including triangular, hexagonal or octagonal-shaped booths or otherwise, wherein adjacent sides would be at an oblique angle to one another rather than perpendicular to one another as in the present arrangement. More than this, booths could be constructed with curved walls.

Furthermore, whilst the booth is constructed by attaching panels to a sub frame, as discussed below, it should be appreciated that the present invention is applicable to booths that have alternative structures, such as booths formed by attaching complete composite or laminate panels to a base.

Moreover, as discussed below, whilst the base preferably extends along a basal edge of a plurality of the walls but does not extend across the opening, there may be arrangements where this is not the case. For example, a nominal threshold entry may be achieved by the provision of an extremely low profile base, at least in the entryway of the booth, in which case the base could extend across the opening. Also, numerous forms of base could be provided, which are not only provided at the periphery of the booth, in contrast to the arrangement shown.

The present invention is not to be limited to the specific structure detailed.

The base 5 of the present arrangement extends along (and under) the basal edge of three of the four walls 102. It does not extend along the basal edge of the wall 102 that defines the opening that is closed by the door 106. It is, accordingly, substantially U-shaped. The base 5 preferably comprises a plurality of elongate sections (not shown) that are connected to one another. With straight walls, the elongate sections are straight. Where curved walls are provided instead then the elongate sections may be correspondingly curved. Adjacent elongate sections in the present arrangement are arranged at a right angle to one another. Where adjacent walls are arranged at angles other than right angles to one another then the angles between adjacent sections may also be adapted accordingly.

The base may be provided at the periphery of the booth only, as clearly seen. In alternative arrangements, this need not be the case. For example, there could be an arrangement where the base was plate like in form or otherwise constructed to extend across the entire floor surface. The booth 1 preferably comprises no floor. However, arrangements will be possible that include a floor covering, such as a carpet or similar within the booth 1.

The elongate sections of the base 5, which extend along the basal edges of the first and second walls may be formed as substantially U-shaped channels (for example by forming profiles with a U-shaped cross-section). They are square U-shaped channels in the present arrangement. The elongate sections could take numerous alternative forms. In line with the discussion above, in alternative forms or shapes of booth there could be more or less U-shaped channels.

Figure 4:
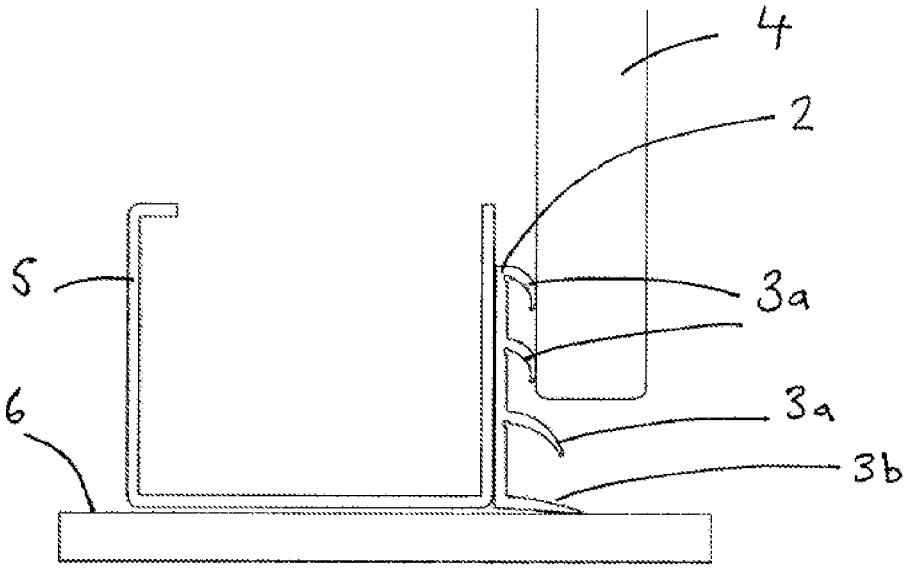
FIG. 4 is a schematic view of the seal of FIG. 1 as part of the booth of FIG. 2, compressed between a supporting member and a panel.

FIG. 3 is a view of an elongate base section (in part) having a square U-shaped cross-section. FIG. 4 is a view of an elongate base section having a square U-shaped cross-section.

In FIG. 3, the adjacent acoustic seal has three first protrusions 3*a* and a single second protrusion 3*b*. Due to the height of outer panel 4 above the level of the floor 6, all three first protrusions are compressed between the base 5 and outer panel 4, with the fins being pressed towards the body portion of the seal and towards the floor.

In FIG. 4, the adjacent acoustic seal has four first protrusions 3*a* and a single second protrusion 3*b*. Due to the height of outer panel 4 above the level of the floor 6, three first protrusions are compressed between the base 5 and outer panel 4 but one first protrusion remains uncompressed.

Accordingly, since a plurality of the first protrusions 3*a* are provided in preferred embodiments of the present invention, these first protrusions being spaced vertically from one another during use, it is possible to provide a soundproof booth with level walls and roof even when the booth is set up on an uneven floor. The design of the acoustic seal preferably provides a tolerance of up to 20 mm or even 30 mm in respect of uneven floor levels.

The elongate sections of the base, such as the U-shaped channels, may be provided with sound absorbing material therein.

To allow for suitable soundproofing, the base will preferably be provided with sound absorbing material (not shown) on a lower surface that is sandwiched between the base and the floor during use. Additionally or alternatively, the base is provided with the acoustic seal 1.

The booth 100 may comprises a sub frame (not shown). The sub frame when present will be fixed to the base 5. Panels, including outer panels 4 and other structural elements or fixtures, may be attached to the sub frame.

The walls 102 comprise at least outer panels 4. The roof 103 is formed by the attachment of at least an additional outer panel on top of the walls 102.

The walls 102 and roof 103 preferably comprise inner and outer panels, wherein any or all of the walls 102 may comprise at least one inner panel and at least one outer panel 4, which oppose one another and comprise respective inner and outer faces of the respective wall 102.

The booth is provided with air inlets 108*a* and air outlets 108*b* for the exchange of air between the internal volume of the booth and the external environment: in this embodiment, the air inlets and air outlets are provided in the roof.

The panels may take any suitable form. They will preferably have sufficient rigidity to prevent sagging. The inner panels may comprise padded fabric panels to provide for acoustic damping. The outer panels 4 may be rigid panels and could be formed from wood, plastic or otherwise. The inner and outer panels could be formed from the same materials or from different materials. There may be sound proofing panels provided between the inner and outer panels. These may be included or omitted in dependence on the acoustic properties of the inner and outer panels.

The walls 102 may comprise multiple smaller inner and outer panels or a single inner panel and a single outer panel. Multiple panels may be arranged to form a substantially flush surface.

It is preferable that the outer panels 4 of the walls and the outer panel of the roof are sealed to one another to provide a sealed outer layer.

With reference to FIG. 3, the acoustic seal 1 is further considered in use in the booth 100.

The acoustic seal 1 extends along the basal edges of each of a plurality of the walls, sandwiched between the base and the outer panel, for sealing a gap G between the outer panel 4 and the base 5.

The first protrusions 3*a* are arranged to be compressed between the outer panel 4 and the base 5, and the second protrusion 3*b* is arranged to contact the floor to seal between the base 5 and the floor 6.

With a plurality of the first protrusions 3*a* spaced vertically from one another during use, a small range of vertical misalignments of the outer panel 4 may be accommodated.

Figure 5:
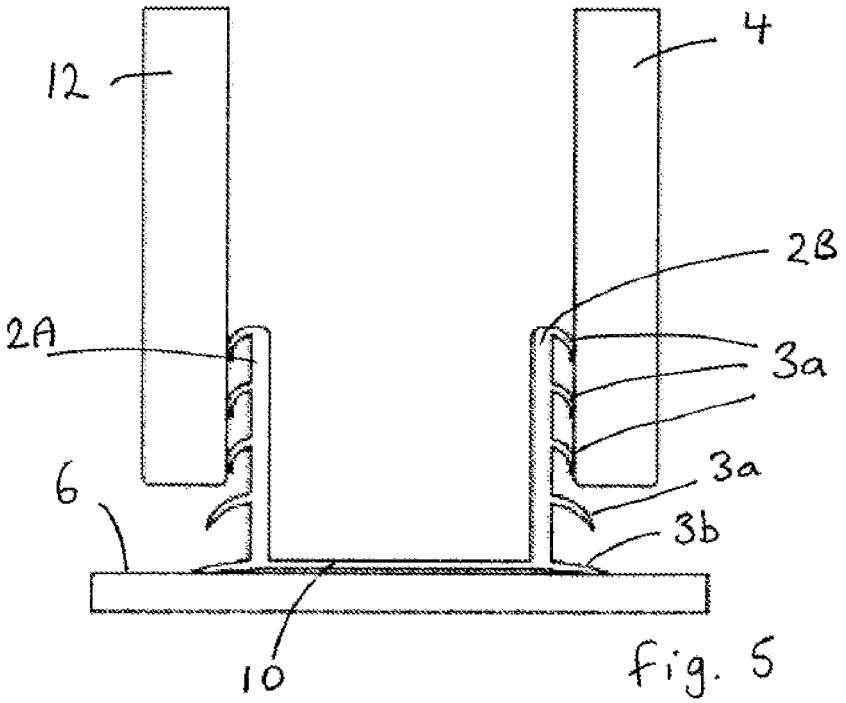
FIG. 5 is a schematic view of another embodiment of the seal of the present invention as part of the booth of FIG. 2, compressed between a supporting member and two panels.

With reference to FIG. 5, an acoustic seal comprising an extrusion has two body portions 2A, 2B and an interconnecting section 10 extending between the two body portions. The first and second protrusions of the first body portion 2A project therefrom in a direction which is opposite to the direction of projection of first and second protrusions from the second body portion 2B. The first and second body portions may be substantially parallel to one another.

The interconnecting section 10 extends between the first body portion 2A and the second body portion 2B to provide an extrusion having a square U-shape in cross-section in this example. The extrusion may be formed from materials of different rigidity, whereby the interconnecting section and the two body portions are sufficiently rigid to form a supporting base for the walls of the booth and the protrusions are sufficiently flexible to form an acoustic seal under compression. Alternatively, a base formed as a substantially U-shaped channel fits snuggly within the extrusion of this example and provides support thereto.

The acoustic seal of FIG. 5 provides a seal with two panels, such as an outer panel 4 and an inner panel 12.

As discussed, the acoustic seal 1 preferably extends along the basal edge of each of a plurality of the walls 102. The acoustic seal may extend around substantially the entire periphery of the base 5. It may extend continuously around the periphery of the base. In the present arrangement with the base being substantially U-shaped, the acoustic seal 1 extends continuously around three basal edges of the booth 100. The acoustic seal 1 preferably extends along the basal edge of the side with the door 106, on either side of the door as far as the door opening.

The door is preferably provided with a drop down seal (not shown) of conventional form that retracts as the door is opened under the force of a spring or otherwise and drops down as the door is shut.

Figure 6A:
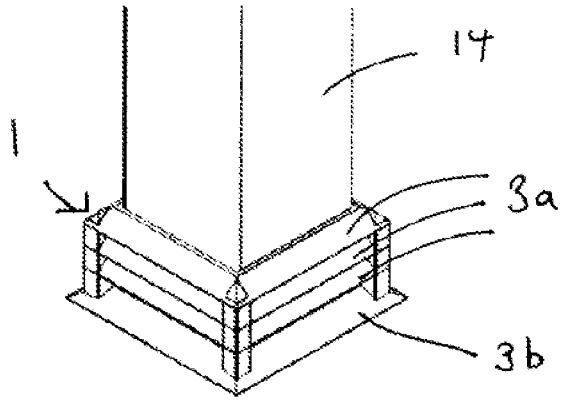
FIGS. 6*a* and 6*b* are perspective views of the seal of FIG. 1 provided on alternative supporting members.
Figure 6B:
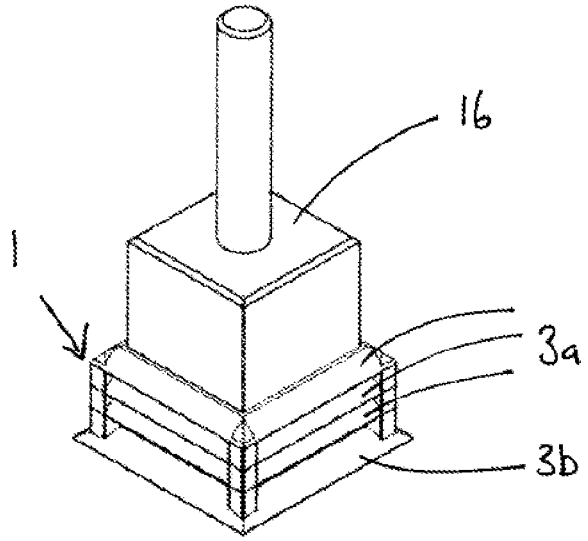

With reference to FIGS. 6*a* and 6*b*, the acoustic seal of the present invention is suitable for extending along the basal edges of a supporting leg 14 and/or a supporting foot 16 of a sound proof booth, by way of example.

The invention has been described above with reference to specific embodiments, given by way of example only. It will be appreciated that many different arrangements of are possible within the scope of the appended claims.

What is claimed is:

1. An acoustic seal comprising an extrusion, which comprises a body portion and a plurality of deformable protrusions that project from the body portion, the protrusions comprising a plurality of first protrusions and a second protrusion that are spaced from one another, wherein the plurality of first protrusions is defined by a plurality of first fins and the second protrusion is defined by a second fin, wherein the first fins and the second fin are spaced apart along a height direction of the body portion, each fin of the plurality of first fins and the second fin extending longitudinally along a length direction of the body portion, and projecting away from the body portion along a same width direction of the body portion, and wherein each of the first fins defining one of the first protrusions comprises an undercut at a base of the first fin where the first fin is joined to the body portion, the undercut extending into the body portion, reducing a thickness of the first fin along the height direction, and increasing resiliency of the first fin.

2. An acoustic seal as claimed in claim 1, wherein each of the plurality of first protrusions extends from the body portion by a different distance to the second protrusion.

3. An acoustic seal as claimed in claim 1, wherein the body portion is substantially planar.

4. An acoustic seal as claimed in claim 1, wherein the fins are curved when in an un-deformed state.

5. An acoustic seal as claimed in claim 1, wherein the fins are tapered in the same width direction extending away from the body portion.

6. An acoustic seal as claimed in claim 1, wherein a surface of the body portion, which is opposed to a surface of the body portion from which the protrusions project, comprises a self-adhesive coating or interconnecting means for connecting the acoustic seal to an adjacent supporting member.

7. A booth comprising an acoustic seal according to claim 1.

8. A booth as claimed in claim 7 comprising upstanding peripheral walls, a roof, a base upon which the booth stands in use, and the acoustic seal, wherein the base extends along a basal edge of at least one of the walls, which comprises an outer panel, and the acoustic seal extends along the basal edge of the wall, sandwiched between the base and the outer panel, for sealing a gap between the outer panel and the base.

9. A booth as claimed in claim 8, wherein at least one of the protrusions is arranged to be compressed between the outer panel and the base that is on a floor, and one of the protrusions is arranged to contact the floor to seal between the base and the floor.

10. A booth as claimed in claim 9, wherein each of the plurality of first protrusions extends from the body by a different distance to the second protrusion and is shorter than the second protrusion, at least one of the plurality of first protrusions being arranged to be compressed between the outer panel and the base and the second protrusion being arranged to contact the floor to seal between the base and the floor.

11. A booth as claimed in claim 8, wherein the acoustic seal extends along the basal edge of each of a plurality of the walls.

12. A booth as claimed in claim 8, wherein the acoustic seal extends around substantially the entire periphery of the base.

13. A booth as claimed in claim 8, wherein the base is substantially U-shaped in cross-section.

* * * * *